United States Patent [19]

Schmidt

[11] Patent Number: 4,907,525

[45] Date of Patent: Mar. 13, 1990

[54] OUTBOARD STORAGE RACK FOR BOATS

[76] Inventor: James E. Schmidt, N. 6515 Moore, Spokane, Wash. 99208

[21] Appl. No.: 211,599

[22] Filed: Jun. 27, 1988

[51] Int. Cl.[4] ..... B60R 9/12

[52] U.S. Cl. ..... 114/364; 211/70.5; 224/917

[58] Field of Search ..... 114/364, 343; 440/104, 440/109; 441/68; 280/809, 814, 815; 248/200, 205.1, 205.5, 205.6, 206.2, 206.3; 211/70.5, 13; 224/42.45, 42.32, 42.33, 42.38, 42.4, 42.42, 42.07, 42.03 R, 42.43, 917, 273

[56] References Cited

U.S. PATENT DOCUMENTS

| | | | |
|---|---|---|---|
| 3,155,238 | 11/1964 | Bennett | 211/70.5 |
| 3,925,836 | 12/1975 | Simmonds | 114/364 |
| 4,056,220 | 11/1977 | Trimble | 211/70.5 |
| 4,231,501 | 11/1980 | Goode | 211/70.5 |
| 4,232,806 | 11/1980 | Shald | 211/70.5 |
| 4,234,112 | 11/1980 | Gallant | 211/70.5 |
| 4,330,065 | 5/1982 | Haddad | 211/60 SK |
| 4,582,015 | 4/1986 | Hunter | 224/917 |

*Primary Examiner*—Joseph F. Peters, Jr.

*Assistant Examiner*—Clifford T. Bartz

*Attorney, Agent, or Firm*—Wells, St. John & Roberts

[57] ABSTRACT

A ski rack is described for releasably attachment to a boat for receiving and supporting skis and the like along the gunwale and outboard of the boat hull. The rack includes a pair of frames mountable to the boat along the gunwale by a clamp device at top ends of the frame. Suction cups are provided at bottom ends of the frames for securing the device to the boat hull. Adjustments are provided for extending and retracting the suction cups according to the boat hull configuration and for angularly adjusting the suction cups to match the contacted hull surface. Horizontal sections of the frame are provided with upright ski retainers to receive and secure skis in position thereon. The retainers are spaced apart horizontally and vertically with one set being situated above and along the gunwale and the other set being vertically spaced downwardly from the first set and outboard of the boat hull to receive and support skis or the like. Spacing of the ski retainers in this manner permits reception of a number of skis while maintaining close proximity of the skis to the boat hull.

16 Claims, 9 Drawing Sheets

OUTBOARD STORAGE RACK FOR BOATS

TECHNICAL FIELD

The present invention relates to racks mountable to boats extending outwardly thereof for the purpose of carrying objects such as water skis and the like.

BACKGROUND OF THE INVENTION

Various forms of outboard carriers have been developed in attempts to solve on board storage of water skis and other like water recreational equipment such as knee boards, towropes, etc.

Several products have been developed that are used to carry water skis outboard of a boat hull. Often, such apparatus is permanently attached to the side or transom of the boat. This is an undesirable situation since the racks appear somewhat unsightly to boating enthusiasts and since they require boring or other machining process that will mar the external surface of the boat.

As a solution to the problem presented by permanent storage racks, various forms of removable racks have been developed. However, these racks, while gaining the advantage of removability, still incorporate certain disadvantages. For example, an outboard storage rack has been developed that is removably secured to the gunwale and hull by a number of suction cups. Suction cups, however, are not appropriate for mounting an outboard rack to a boat since the boat is constantly moving and bounding when in use. Such motion, coupled with the cantilevered weight of skis mounted to the rack, results in a possibility that the rack will slip from engagement with the boat and fall into the water, along with the skis mounted thereto. It has been found that suction cups placed in contact with the horizontal surfaces of a gunwale are not likely to maintain desirable holding characteristics as shear stress on the suction cups is too significant in many cases. Suction cups used to brace a ski rack against a boat hull, however, appear to be effective for this purpose since the suction cups in this orientation are placed primarily under constant tension or compression stresses in which the suction cups in general exhibit maximum holding strength.

Other forms of racks have been developed that utilize bracket mounts for attaching an inboard end of the rack to the gunwale of a boat and that include outward projecting support arms that are substantially cantilevered over the gunwale to receive water skis. This form of rack while providing ample forces for mounting the rack to the boat gunwale, produces dangerous amounts of stress through the cantilever nature of the outwardly projecting arms.

It therefore remains desirable to obtain some form of portable, removable rack that can be attached to a boat for the purpose of carrying items such as water skis and the like that can be securely mounted to a boat yet that will remain easily removable and that will carry skis or other equipment safely in close proximity to the boat hull.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 1:
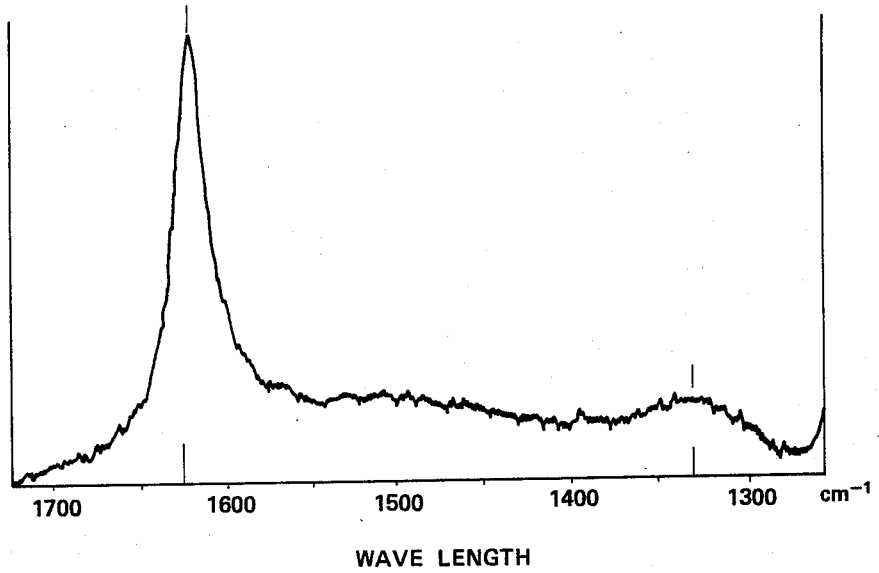
FIG. 1 is a practical view of a boat with the present rack mounted thereto.
Figure 2:
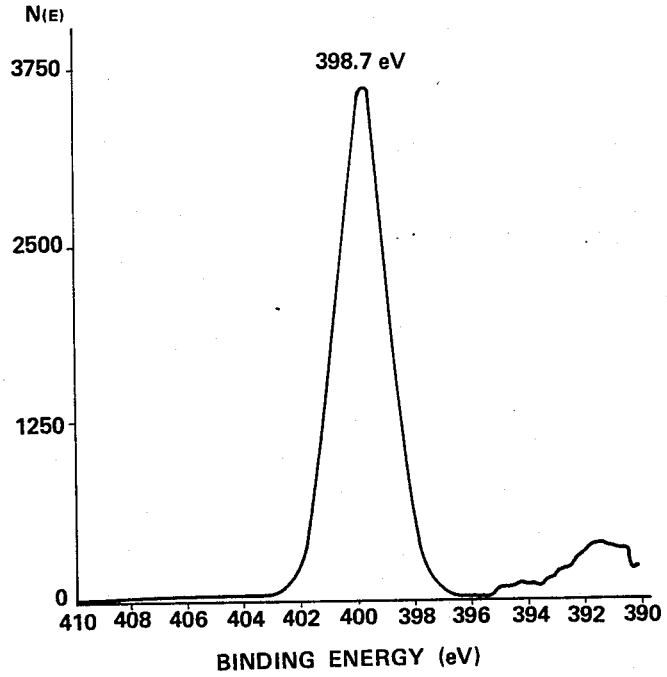
FIG. 2 is a side elevation view as seen from the left in FIG. 1.
Figure 3:
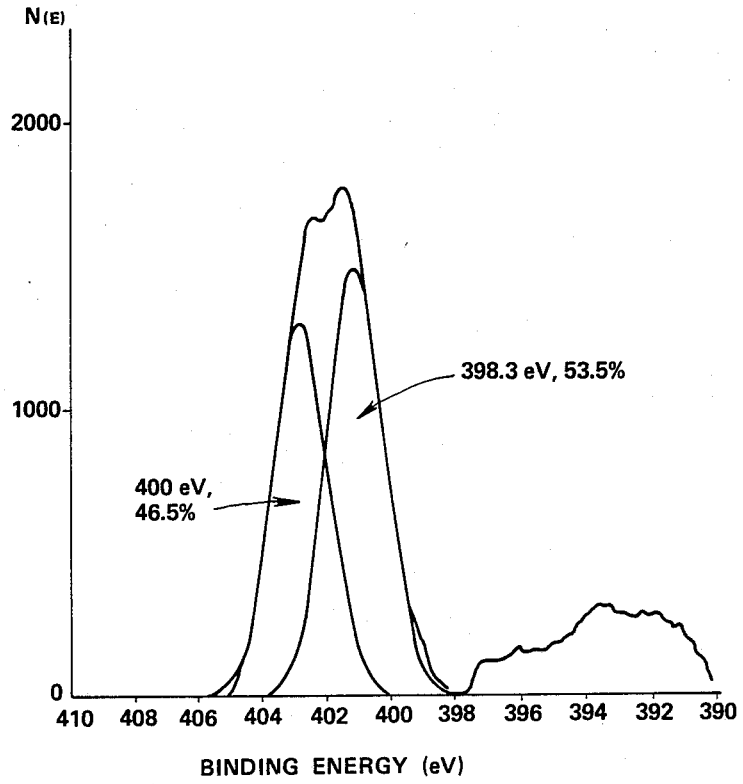
FIG. 3 is a side elevation view opposite to that shown in FIG. 2.

FIG. 1 illustrates a boat generally designated by reference numeral 10. The boat 10 is of a standard "runabout" configuration that is often used by recreational boating enthusiasts for water sports such as water skiing, knee boarding, etc. For purposes of later description, the boat 10 includes a hull 11 and longitudinal substantially horizontal gunwales 12. Upright angular or substantially vertical portions of the hull extend above the water line and are generally designated as upright hull sidewalls 13. The angularity of the sidewalls 13 and the configuration of the gunwale 12 vary from one model of boat to another. Some boats include relatively vertical hull sidewalls while others include sharply angular sidewall constructions. Gunwales also are typically fairly flat and horizontal along top surfaces. However, they may also include tapered side edges that lead from the flat top surfaces downwardly on the outboard side to a rim or rubbing strip 14 that extends substantially about the periphery of the boat. Inwardly angled surfaces of the gunwales lead often to inward wall surfaces 15 of the interior compartment of the boat. The dimension laterally across the gunwale will also vary substantially from one boat to another.

The present storage rack is indicated at 18 and is provided to removably mount to the side of a boat with provisions for storing skimming device such as water skis and the like in an unobstructive, substantially outboard orientation in relation to the passenger compartment within the boat.

Specifically, the present ski rack 18 includes a pair of longitudinally spaced stair-step frames 19. The frames 19 are advantageously identical to one another and connected by at leasst one longitudinal bar 17. The frames 19 and bar 17 may be formed of a relatively lightweight yet rigid material such as plastic that is injection molded or otherwise formed advantageously into the configurations substantially as shown.

Each of the stair-step frames 19 extends from a top end 20 to a bottom end 21. Each is also comprised of a top horizontal section 22 and a bottom horizontal section 23. Sections 22 and 23 are spaced elevationally from one another and horizontally by a vertical section 24. The vertical section 24 may include an intermediate step 25 to space the bottom horizontal section 23 outboard of the top section 22 and to accommodate boats having odd size or angular gunwale configurations. The intermediate section may also be utilized to provide sufficient space between water skis mounted at the bottom section 23 and the hull side wall 13 to permit positioning of the typical rubber ski boot section between the rack and the boat hull.

A clamp means is provided at 26 for securely fastening the top end 20 of the ski rack to the gunwale 12. Clamp means 26 preferably includes a substantially vertically clamp member 27. Clamp member 27 extends longitudinally between the paired frames 19. The member 27 is substantially vertical to assure adaptation to various style gunwales.

The clamp member 27 is adjustably secured to the rack through a threaded portion 28 on each top horizontal section 22. Manually adjustable nuts 29 threadably engage the threaded portions 28 to selectively urge the clamp member 27 against the gunwale 12. This clamping force also pulls the vertical frame sections 24 against the outboard surfaces of the gunwale, thereby securely clamping the upward frame ends to the boat.

The vertical clamp frame or member 27 is substantially horizontally opposed to the top vertical section of the frame and is adjustably spaced by the nuts 29 and threaded section 28 to receive and clamp gunwales of various different dimensions. This feature permits secure clamping of the top frame sections to a variety of different boats.

A suction cup means 34 is provided at the bottom frame ends 21. Suction cup means 34 is provided to releasably attach the bottom frame ends to the upright hull sides 13 of the boat. Means 34 is preferably comprised of a suction cup 35 for each frame 19. The suction cup may be of a standard variety having capability to deflect and secure itself by vacuum seal to the smooth hull surface of a boat. The suction cup may be formed of rubber or similar conventional plastic material commonly used for such purposes.

An angle adjusting means 36 is provided mounting the suction cup means to the bottom frame end for selective angular adjustment. The angle adjusting means facilitates adjustment of the suction cups to conform angularly with the upright hull side 13 of the boat.

Figure 6:
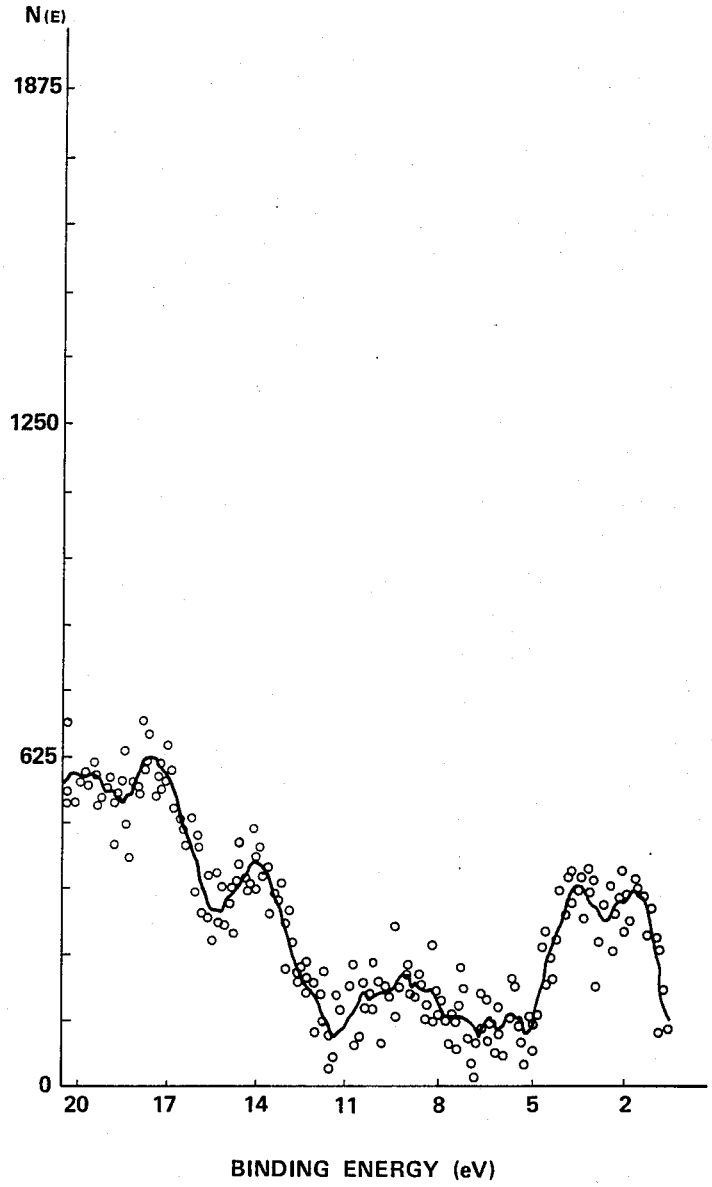
FIG. 6 is a fragmented view of a suction cup extension and angle adjusting mechanism.
Figure 7:
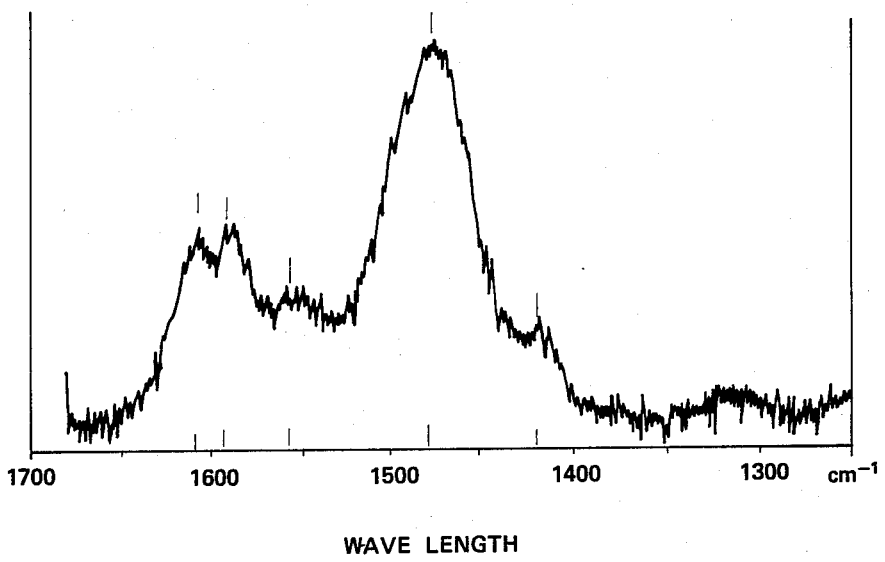
FIG. 7 is a top plan view of the elements shown in FIG. 6.
Figure 8:
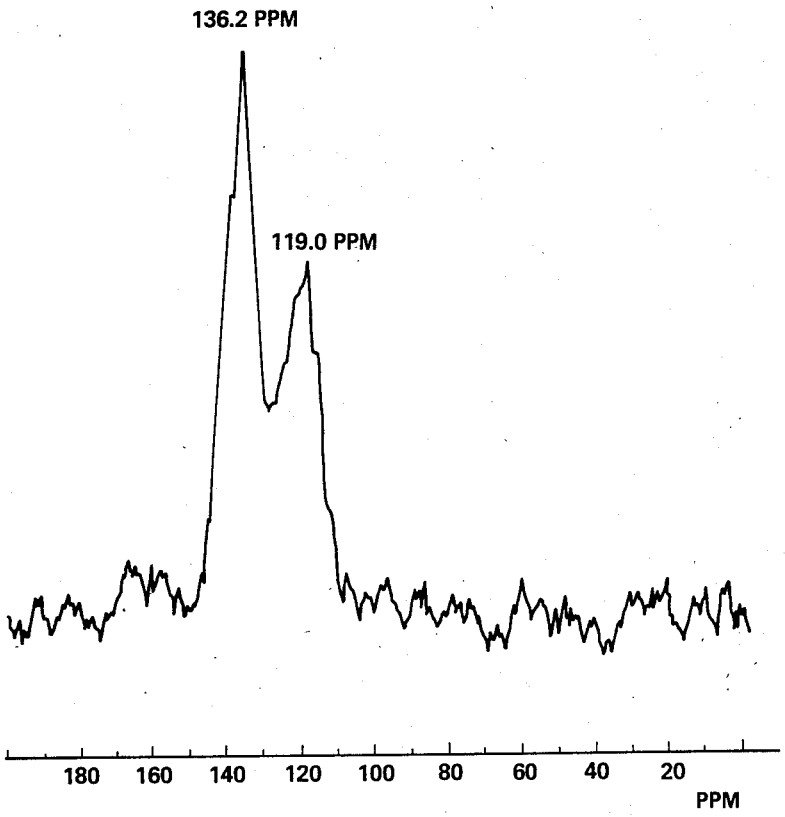
FIG. 8 is an operational view illustrating orientation of the suction cup in relation to a boat hull side surface shown in dashed lines.
Figure 9:
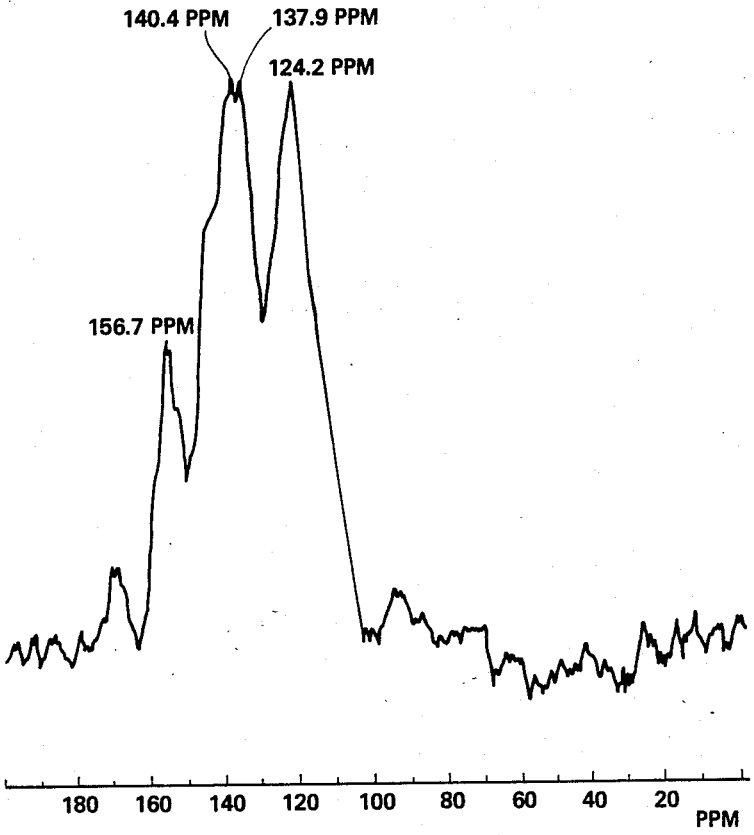
Figure 10:
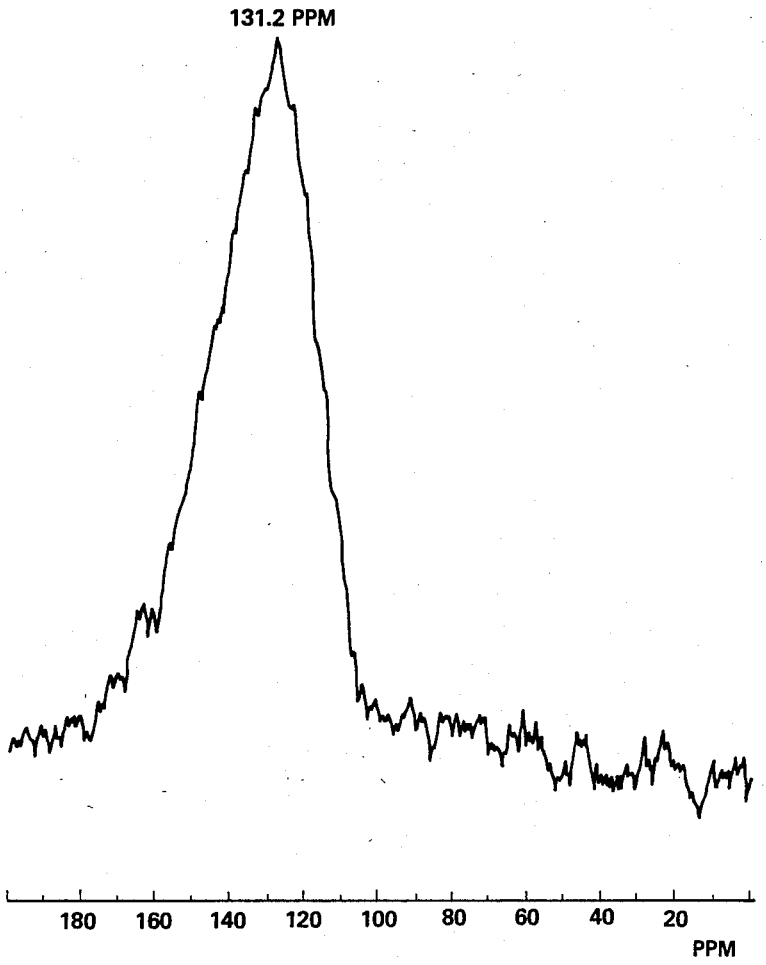
Figure 1:
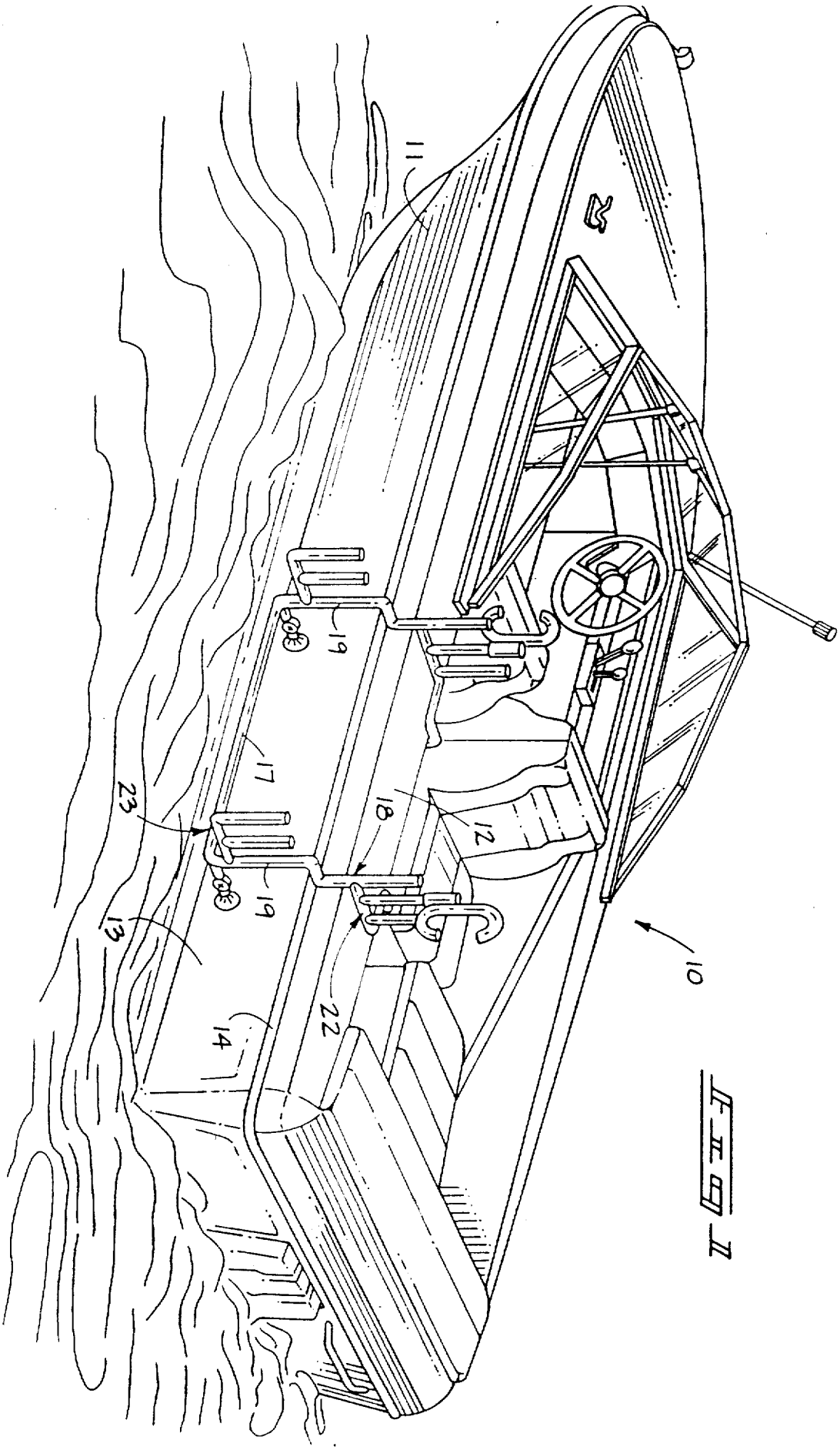
Figure 2:
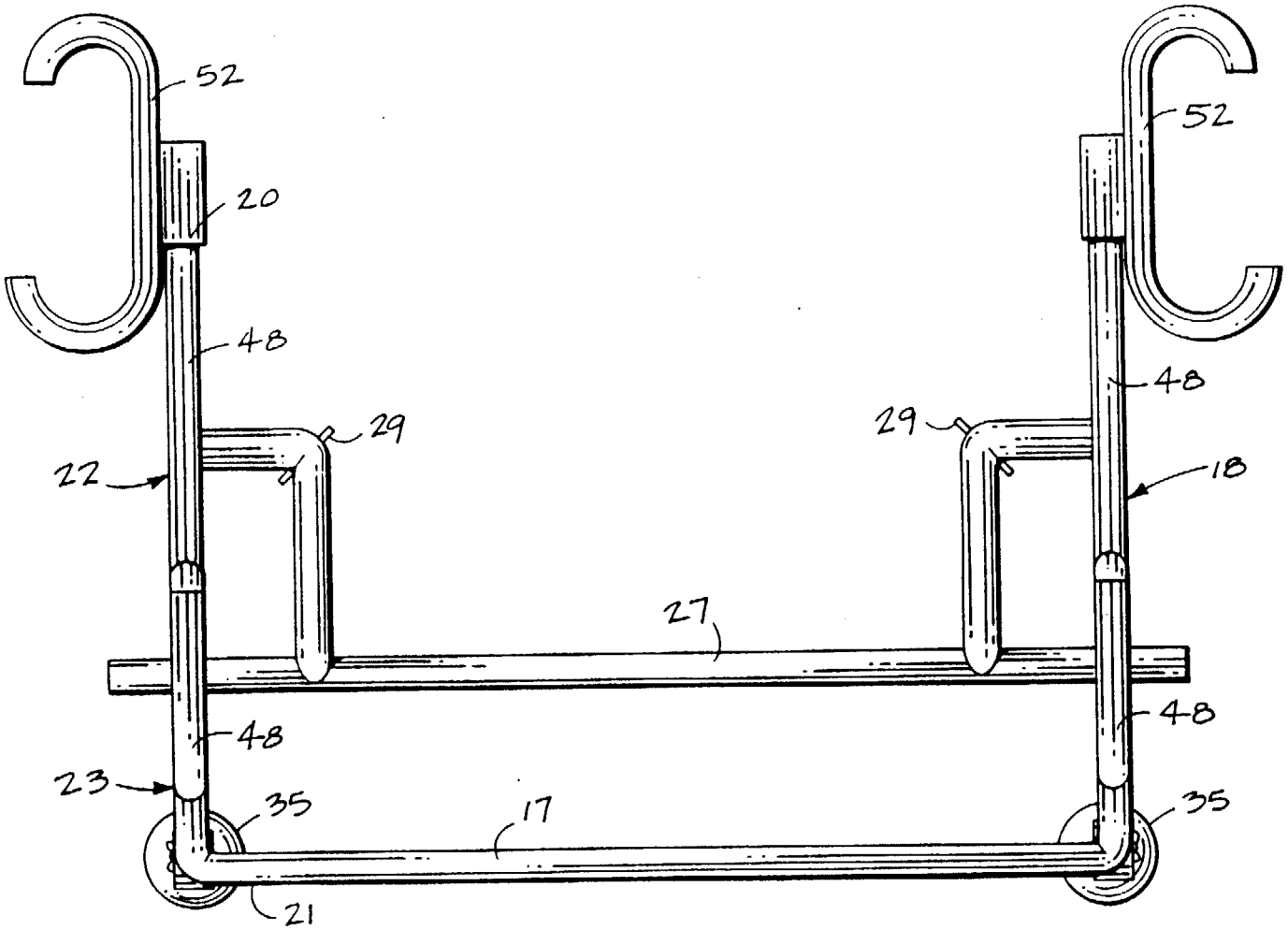
Figure 3:
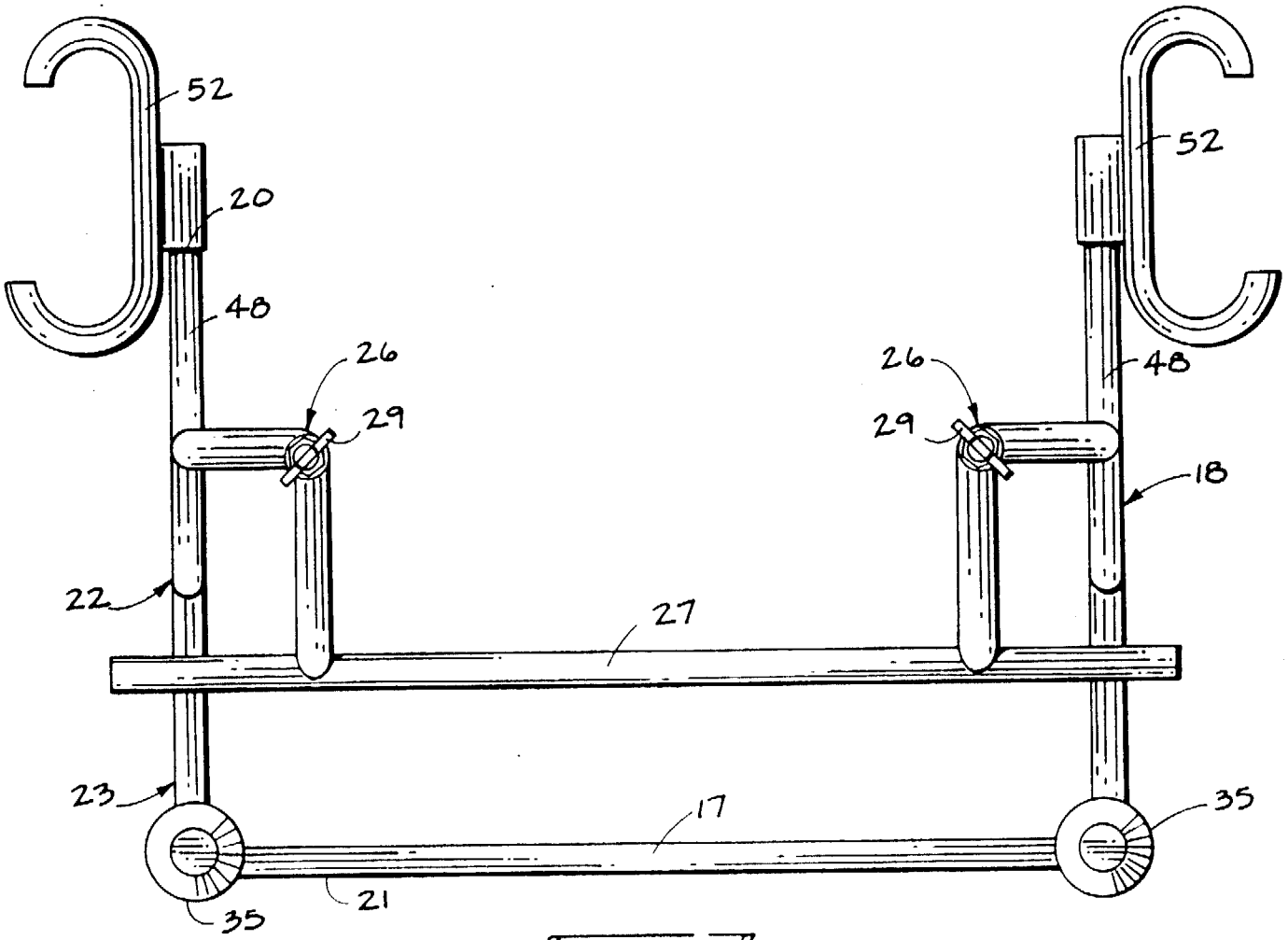
Figure 4:
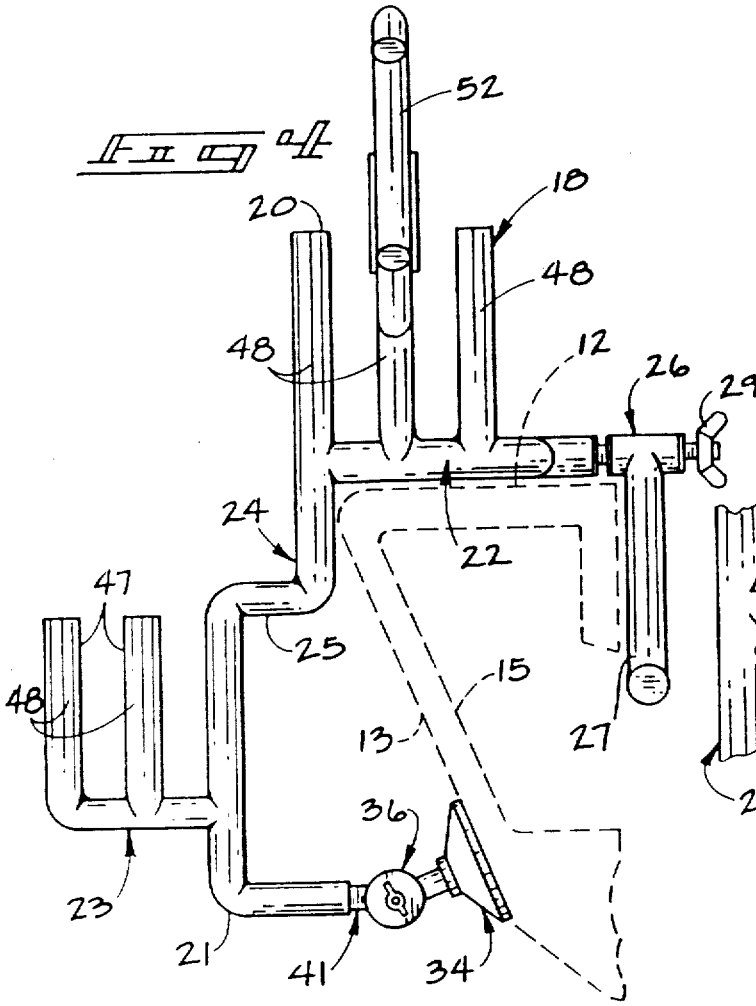
Figure 5:
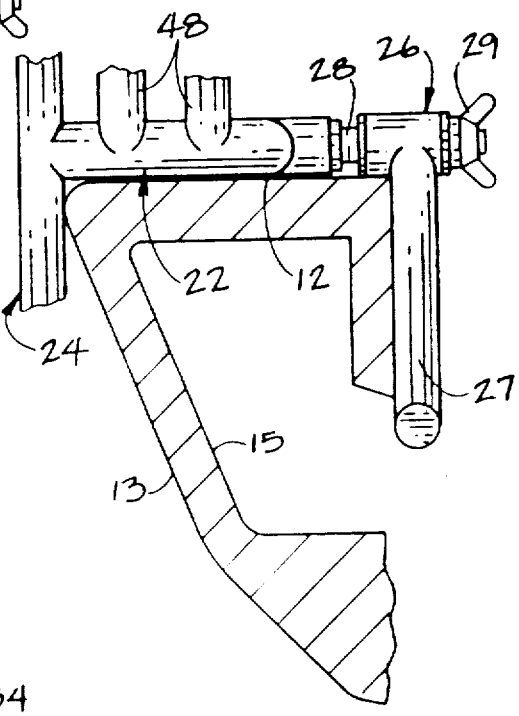
Figure 6:
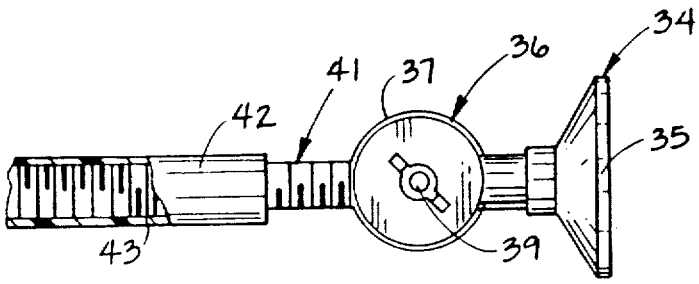
Figure 8:
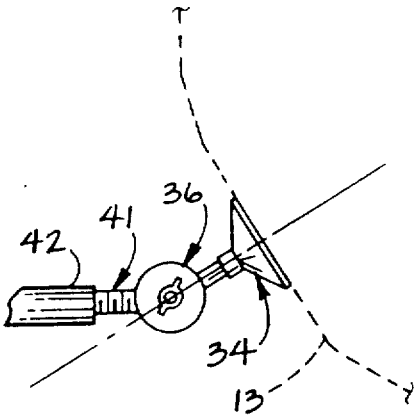
Figure 7:
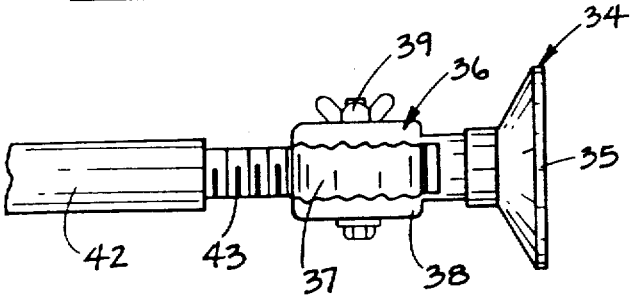

The angle adjusting means is shown in substantial detail in FIG. 6–8. It preferably includes a central disk 37 on each bottom frame end. One or more clamp plates 38 are provided alongside the disk 37 and are attached to the suction cup 35. Wing nut assemblies 39 may be provided to selectively secure the clamp plates frictionally or with interlocking serrations to the disks 37 to selectively prevent pivotal motion of the suction cup about the axis of the wing nut assembly. This axis is preferably positioned substantially parallel to the surface of the hull side wall 13.

The suction cups may be pivoted into an angular relationship substantially matching the angular relationship of the hull surface as indicated in FIG. 8. The axes of the suction cups are therefore substantially perpendicular to the engaged surface of the hull. Angular adjustment is made simply by loosening the wing nuts, adjusting the angular position of the suction cups to a desired position, then subsequently tightening the wing nuts. The wing nuts will force the clamp plates 38 against the disks and therefore hold the suction cups in the selected angular orientations. The suction cups may be independently adjusted to accommodate for longitudinal curvature of the boat hull if necessary.

Further adjustment of the suction cups is provided by horizontal extension means 41 on each frame. Horizontal extension means 41 is situated between the suction cup angle adjusting means 36 and the individual frames 19 for selectively horizontally extending or retracting the associated suction cup to accommodate boats having varying angle hull sides. This adjustment feature includes horizontal sections 42 of the frames 19. The horizontal sections are preferably hollow and include internal threads. These threaded sections receive similarly threaded members 43 that are mounted to the disks 37. The members 43 can be rotated to thereby extend or retract the attached suction cups toward or away from the adjacent surface of a boat hull.

Selective adjustment of the angle adjusting means 36 and horizontal extension means 41 facilitates selective positioning of the associated suction cups 35 to accommodate boats having various hull configurations. Once selectively adjusted, the suction cups may be utilized to effectively attach the bottom frame end to the associated boat.

It is noted, (as may be seen in FIG. 4) that forces applied to the suction cup in this configuration are substantially axial in relation to the axis of the suction cups. That is, the weight of skis resting on the frames will have a tendency to pivot the frames inwardly, compressing the suction cups against the frames. This force, being substantially axial, serves to hold and continuously press the suction cups against the frame, holding them secure in position. Suction cups 35 therefore function readily to hold the bottom end in position as the axial force is relatively continuous and because there is little shear force applied to the suction cups due to the geometry of the frames and the contact established through the clamp means 26 at the frame top ends.

Skis are mounted to the present rack by a ski retainer means 47. The retainer means 47 is situated on horizontal sections of the frames for mounting pairs of skis or the like in horizontal and vertical spaced relation along the gunwale 12 and outboard thereof adjacent the upright hull side wall 13.

The ski retainer means includes a number of upright members 48. The members 48 are spaced apart horizontally on the horizontal frame sections 22, 23 by sufficient distances to receive pairs of skis therebetween. Skis thus received will be oriented longitudinally with respect to the boat and will be situated at locations outboard of the occupant area within the boat.

Sets of skis may be mounted to the upright members 48 situated along the top horizontal section 22. Skis situated in this position will substantially longitudinally overlie the gunwale. Skis may also be mounted to or between the upright members 48 on the bottom horizontal section 23. Skis mounted in this position will be outboard of the gunwale and the boat hull and will be substantially vertically spaced from the skis mounted at the top frame ends.

The staggered vertical and horizontal spacing of the ski mounting upright members 48 is such that a number of pairs of skis or the like can be mounted to the device without requiring that the frame be extended or cantilevered outwardly of the hull construction by a considerable distance. Vertical spacing of the upright members allows the boot sections of the skis to extend in opposite directions without interference from an adjacent ski.

A ski rope retainer 52 may be provided on the top frame end 20. The ski rope retainer may be releasably attached to any of the upright members 48. It includes oppositely facing ski rope receiving surfaces to provide a convenient area to receive and mount the ski rope. The rope is therefore retained in a safe position for ready access.

The present structure is very simple to adapt for mounting to various different forms of boats.

Figure 4:
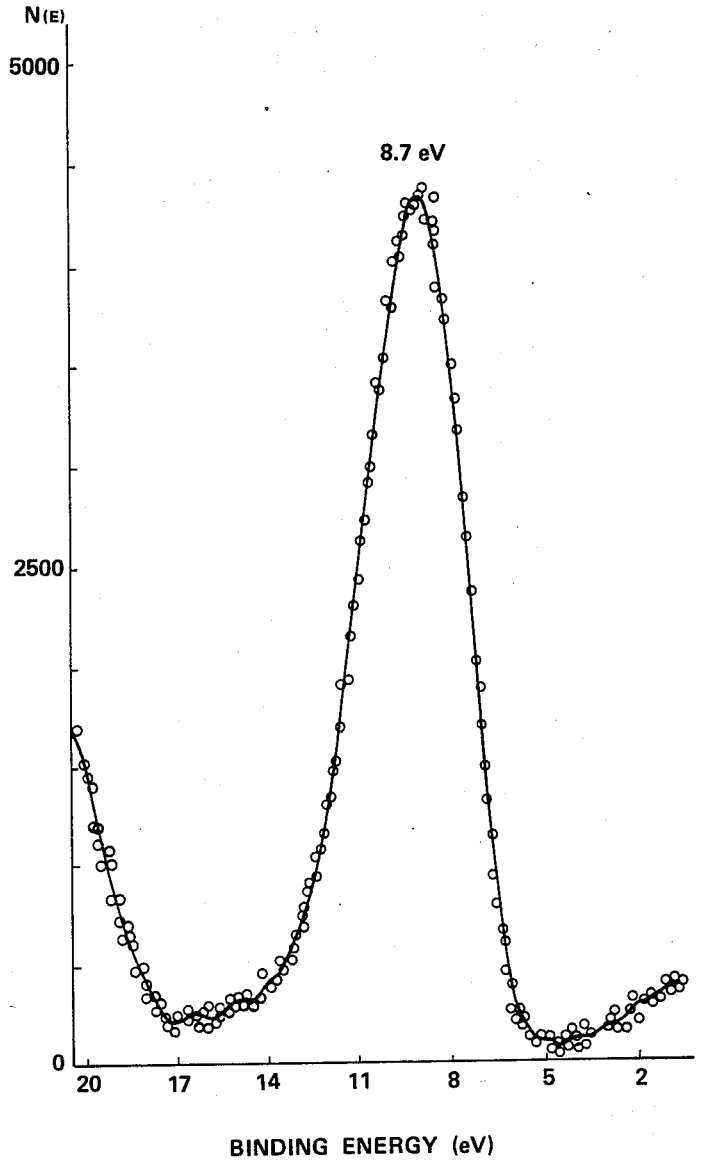
FIG. 4 is an end elevation view.
Figure 5:
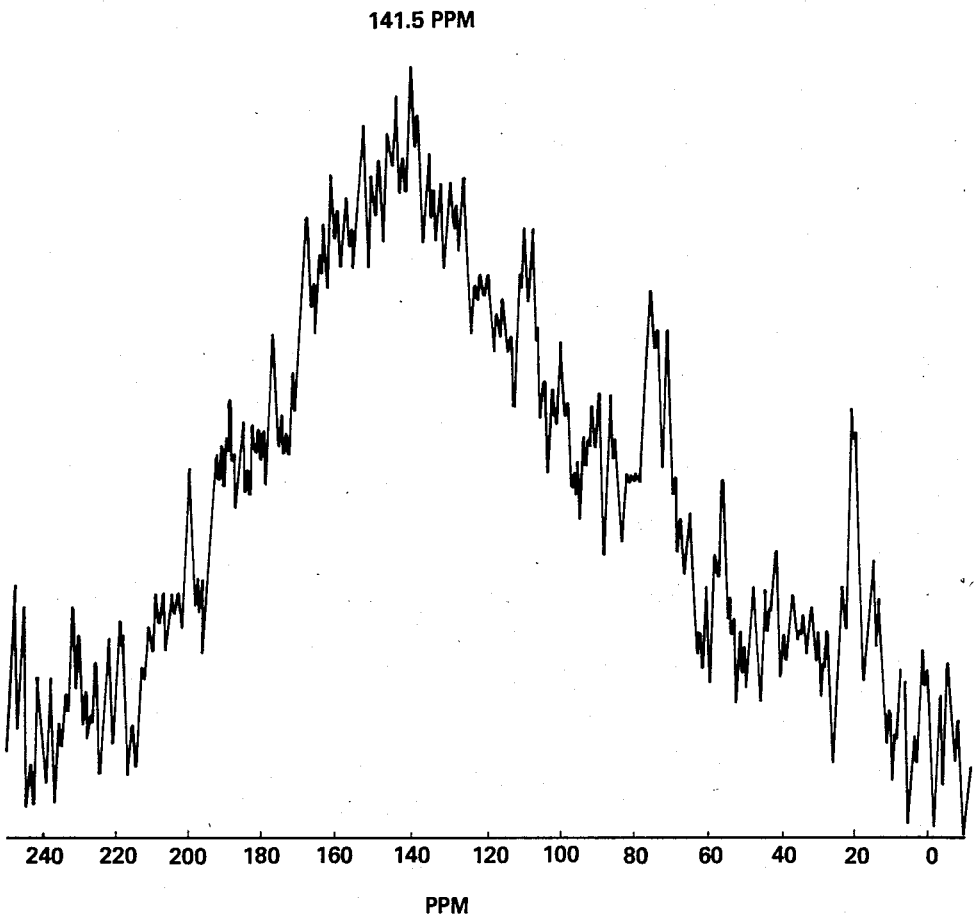
FIG. 5 is a fragmented view illustrating a gunwale clamping arrangement of the present invention.

Prior to use, the device is simply installed by first fitting the frames over the gunwale of a boat so the vertical clamp member 27 is situated on the inboard gunwale side and the vertical frame sections 24 are situated on the outboard gunwale side. The rack is also preferably positioned with the top horizontal section 22 resting against the upright surface of the gunwale. This relationship is best shown in FIGS. 4 and 5. FIG. 4 illustrates the clamp arrangement in a loose configuration. FIG. 5 shows the clamp arrangement with the associated nut 29 tightened to secure the rack across the gunwale.

If necessary, adjustments may be made at this time to accommodate the hull configuration of the boat to receive the suction cup means 34. This may be done by adjusting the angle adjusting means 36 or the horizontal extension means 41 or both. Appropriate adjustments are made to extend or retract the suction cups so as to locate the suction cups against the boat hull configuration with the vertical sections 24 of frames 19 situated substantially vertically as indicated in FIG. 4.

Next, adjustments may be made using the angle adjusting means 36 to orient the suction cups with their axes substantially perpendicular to the surface of the boat hull to be engaged. This is done by loosening the wing nuts 39 and pivoting the suction cups about the axes of the wing nut assemblies into the plane of the adjacent surface of the boat hull. The wing nuts are then tightened and the device is pressed against the boat hull to secure the suction cups in place.

The rack is now ready to use. Skis or the like can now be placed in the ski retainer means 47 and carried securely along the gunwale or outboard of the boat hull. In either position, the skis are away from the occupant area within the boat. Furthermore, the skis are carried in a secure manner due to the proximity of the skis to the boat and the secure nature of the gripping relationship established by the clamp means 26 and by the adjustable suction cup arrangement.

A ski rope may also be stored by the ski rope retainer 52 when mounted to any one pair or longitudinally spaced pair of the upright members 48. The ski rope may simply be wrapped about the ski rope retainer to safely store the ski rope and prevent tangling thereof. The ski rope will then be positioned away from the occupant area of the craft where it could otherwise cause a safety hazard.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A rack for water swimming devices such as water skis mountable to a boat having a gunwale and a substantially upright hull side, the rack comprising:

a frame having a top end above the gunwale and a bottom end below the gunwale and including a top horizontal section at the top end, an outboard vertical section extending downwardly from the top horizontal section; and a bottom horizontal section extending outboard of the outboard vertical section at the bottom frame end;

clamp means at the top end of the frame, for releasably clamping the top end of the frame securely to the gunwale of the boat;

suction cup means at the bottom end of the frame for releasably attaching the bottom frame end to the upright hull side of the boat;

suction cup angle adjusting means at the bottom frame end mounting the suction cup means to facilitate angular adjustment of the suction cup means thereon to conform angularly with the upright hull side of the boat; and retaining means on horizontal sections of the frame for mounting water skimming devices such as pairs of water skis in horizontal and vertically spaced relation along the gunwale and outwardly thereof adjacent the upright hull side.

2. The rack of claim 1 further comprising a ski rope retainer on the top frame end.

3. The rack of claim 2 wherein the ski rope retainer is removably mounted to the frame.

4. The rack of claim 1 further comprising a horizontal extension means between the suction cup angle adjusting means and the frame for selectively horizontally extending or retracting the suction cup to accommodate boats having varying angle hull sides.

5. The rack of claim 1 wherein the clamp means includes a substantially vertical clamp frame member and means for adjustably securing the vertical clamp member against the gunwale along an inboard edge thereof.

6. The rack of claim 5 wherein the clamp frame is horizontally opposed to the outboard vertical section of the frame and is adjustably spaced therefrom to receive and clamp the gunwale between the outboard vertical section and the vertical clamp frame member.

7. The rack of claim 5 wherein the top horizontal section of the frame extends horizontal between the top vertical frame section and the clamp means to transversely span the gunwale of a boat and wherein the retaining means includes upright horizontally spaced bars on the top horizontal section.

8. A rack for mounting water skimming devices such as water skis to a boat having a gunwale and an outward facing hull side surface extending downwardly from the gunwale, comprising:

a pair of upright frames, each having top and bottom ends and being comprised of top and bottom horizontal sections spaced apart elevationally by an outboard substantially vertical section;

an elongated bar interconnecting the frames and spacing them longitudinally along the gunwale and hull;

clamp means spanning the gunwale and having upright clamp members at the top ends of the frames for clamping the gunwale of the boat securely between the outboard upright frame sections and the upright clamp members;

suction cup means at the bottom end of each frame for releasable attachment to the upright hull side of the boat; and retaining means on the horizontal sections of the frame for mounting water skimmings devices such as pairs of water skis in horizontal and vertically spaced relation along the gunwale and outwardly thereof adjacent the upright hull side.

9. The combination of claim 8 further comprising suction cup angle adjusting means between each suction cup means and bottom frame end for adjusting the angular orientation of the suction cup to match the angular orientation of the boat hull side surface.

10. The combination of claim 9 further comprising a ski rope retainer on the top frame ends.

11. The combination of claim 10 wherein the ski rope retainer is removably mounted to the frames.

12. The combination of claim 8 further comprising a horizontal extension means between the suction cup angle adjusting means and the frames for selectively horizontally extending or retracting the suction cup means to accommodate boats having varying angle hull sides.

13. The combination of claim 8 wherein the clamp member is horizontally opposed to the top vertical sections of the frames and adjustably spaced therefrom to receive and clamp the gunwale of a boat therebetween.

14. The combination of claim 13 wherein the top horizontal sections of the frames extend horizontally between the top vertical frame sections and an upright clamp member to transversely span the gunwale of a boat and wherein the retaining means includes upright horizontally spaced members on the top horizontal sections.

15. The combination of claim 8 wherein the top horizontal sections span the gunwale and the bottom horizontal sections extend outboard of the hull side surface, and wherein the retaining means is comprised of upright horizontally spaced members on the top and bottom horizontal sections.

16. The combination of claim 8 wherein the retaining means is comprised of upright horizontally spaced bars on the top horizontally sections of the frames and further comprising a rope retainer mounted to the upright horizontally spaced bars.

* * * * *

UNITED STATES PATENT AND TRADEMARK OFFICE

CERTIFICATE OF CORRECTION

PATENT NO. : 4,907,525

DATED : March 13, 1990

INVENTOR(S) : James E. Schmidt

It is certified that error appears in the above-identified patent and that said Letters Patent is hereby corrected as shown below:

On the title page, "16 Claims, 9 Drawing Sheets" should read --16 Claims, 4 Drawing Sheets--

The title page should be deleted to appear as per attached title page.

The sheets of Drawing consisting of Figs. 1-10 should be deleted to appear as per attached sheets.

Signed and Sealed this

Twenty-third Day of April, 1991

*Attest:*

*Attesting Officer*

HARRY F. MANBECK, JR.

*Commissioner of Patents and Trademarks*

United States Patent [19]

Schmidt

[11] Patent Number: 4,907,525

[45] Date of Patent: Mar. 13, 1990

[54] OUTBOARD STORAGE RACK FOR BOATS

[76] Inventor: James E. Schmidt, N. 6515 Moore, Spokane, Wash. 99208

[21] Appl. No.: 211,599

[22] Filed: Jun. 27, 1988

[51] Int. Cl.[4] ..... B60R 9/12

[52] U.S. Cl. ..... 114/364; 211/70.5; 224/917

[58] Field of Search ..... 114/364, 343; 440/104, 440/109; 441/68; 280/809, 814, 815; 248/200, 205.1, 205.5, 205.6, 206.2, 206.3; 211/70.5, 13; 224/42.45, 42.32, 42.33, 42.38, 42.4, 42.42, 42.07, 42.03 R, 42.43, 917, 273

[56] References Cited

U.S. PATENT DOCUMENTS

| | | | |
|---|---|---|---|
| 3,155,238 | 11/1964 | Bennett | 211/70.5 |
| 3,925,836 | 12/1975 | Simmonds | 114/364 |
| 4,056,220 | 11/1977 | Trimble | 211/70.5 |
| 4,231,501 | 11/1980 | Goode | 211/70.5 |
| 4,232,806 | 11/1980 | Shaid | 211/70.5 |
| 4,234,112 | 11/1980 | Gallant | 211/70.5 |
| 4,330,065 | 5/1982 | Haddad | 211/60 SK |
| 4,582,015 | 4/1986 | Hunter | 224/917 |

*Primary Examiner*—Joseph F. Peters, Jr.

*Assistant Examiner*—Clifford T. Bartz

*Attorney, Agent, or Firm*—Wells, St. John & Roberts

[57] ABSTRACT

A ski rack is described for releasably attachment to a boat for receiving and supporting skis and the like along the gunwale and outboard of the boat hull. The rack includes a pair of frames mountable to the boat along the gunwale by a clamp device at top ends of the frame. Suction cups are provided at bottom ends of the frames for securing the device to the boat hull. Adjustments are provided for extending and retracting the suction cups according to the boat hull configuration and for angularly adjusting the suction cups to match the contacted hull surface. Horizontal sections of the frame are provided with upright ski retainers to receive and secure skis in position thereon. The retainers are spaced apart horizontally and vertically with one set being situated above and along the gunwale and the other set being vertically spaced downwardly from the first set and outboard of the boat hull to receive and support skis or the like. Spacing of the ski retainers in this manner permits reception of a number of skis while maintaining close proximity of the skis to the boat hull.

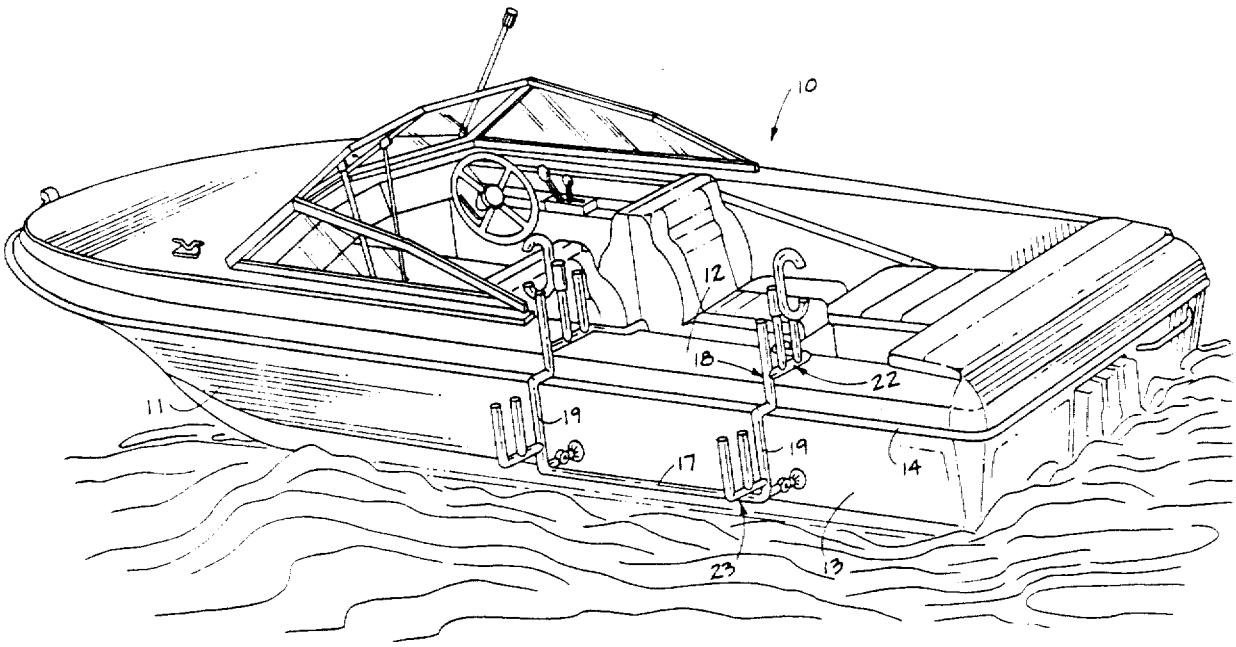

16 Claims, 9 Drawing Sheets